US007693455B2

(12) United States Patent
Tokuwaki et al.

(10) Patent No.: US 7,693,455 B2
(45) Date of Patent: Apr. 6, 2010

(54) CONDUCTIVE MEMBER, PROCESS CARTRIDGE HAVING CONDUCTIVE MEMBER, AND IMAGE FORMING APPARATUS HAVING PROCESS CARTRIDGE

(75) Inventors: Taisuke Tokuwaki, Sagamihara (JP); Yutaka Narita, Sagamihara (JP); Toshio Kojima, Isehara (JP); Tadaaki Hattori, Hadano (JP); Makoto Nakamura, Ebina (JP); Tadayuki Oshima, Atsugi (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 337 days.

(21) Appl. No.: 11/836,950

(22) Filed: Aug. 10, 2007

(65) Prior Publication Data

US 2008/0038016 A1 Feb. 14, 2008

(30) Foreign Application Priority Data

Aug. 10, 2006 (JP) ..... 2006-217913

(51) Int. Cl.
*G03G 15/02* (2006.01)

(52) U.S. Cl. ..... 399/168; 399/174; 399/176

(58) Field of Classification Search ..... 399/168, 399/174, 176; 361/225; 492/18, 39, 47
See application file for complete search history.

(56) References Cited

U.S. PATENT DOCUMENTS 5,535,088 A * 7/1996 Sato et al. ..... 361/225
6,163,671 A * 12/2000 Ishiyama et al. ..... 399/176
6,771,920 B2 * 8/2004 Abe et al. ..... 399/176
7,139,512 B2 * 11/2006 Namiki et al. ..... 399/176
7,151,904 B2 12/2006 Narita et al.
7,493,064 B2 * 2/2009 Narita et al. ..... 399/176
2005/0100365 A1 5/2005 Narita et al.

(Continued)

FOREIGN PATENT DOCUMENTS

EP 0 672 961 A2 9/1995

(Continued)

OTHER PUBLICATIONS

U.S. Appl. No. 12/044,521, filed Mar. 7, 2008, Oshima, et al.

(Continued)

*Primary Examiner*—Hoan H Tran
(74) *Attorney, Agent, or Firm*—Oblon, Spivak, McClelland, Maier & Neustadt, L.L.P.

(57) ABSTRACT

A conductive member to be disposed so as to abut on an image carrier is provided. The conductive member includes an elongate conductive supporter, an electrical resistance adjusting layer formed on a circumferential surface of the supporter, and a pair of gap maintaining members provided respectively to the two ends of the adjusting layer. A gap with a certain clearance between an outer circumferential surface of the adjusting layer and an outer circumferential surface of the image carrier provided in parallel to the adjusting layer is formed. A stepped portion is formed in a joint section between the adjusting layer and each of the gap maintaining members with the joint section. An inclination is formed so as to be continuously inclined from the outer circumferential surface of each of the gap maintaining members to the outer circumferential surface of the adjusting layer in the stepped portion.

18 Claims, 6 Drawing Sheets

U.S. PATENT DOCUMENTS

| | | | |
|---|---|---|---|
| 2006/0188293 | A1 | 8/2006 | Narita et al. |
| 2006/0270541 | A1 | 11/2006 | Narita et al. |
| 2007/0166076 | A1 | 7/2007 | Oshima et al. |

FOREIGN PATENT DOCUMENTS

| | | |
|---|---|---|
| JP | 63-149668 | 6/1988 |
| JP | 1-267667 | 10/1989 |
| JP | 3-240076 | 10/1991 |
| JP | 4-358175 | 12/1992 |
| JP | 5-107871 | 4/1993 |
| JP | 2005-91818 | 4/2005 |
| JP | 3844658 | 8/2006 |
| JP | 2007-11026 | 1/2007 |

OTHER PUBLICATIONS

U.S. Appl. No. 11/837,751, filed Aug. 13, 2007, Nakamura, et al.
U.S. Appl. No. 11/854,947, filed Sep. 13, 2007, Oshima, et al.

* cited by examiner

CONDUCTIVE MEMBER, PROCESS CARTRIDGE HAVING CONDUCTIVE MEMBER, AND IMAGE FORMING APPARATUS HAVING PROCESS CARTRIDGE

PRIORITY CLAIM

The present application is based on and claims priority from Japanese Patent Application No. 2006-217913, filed on Aug. 10, 2006, the disclosure of which is hereby incorporated by reference in its entirety.

BACKGROUND OF THE INVENTION

1. Field of the Invention

The present invention relates to: a conductive member used in an image forming apparatus such as a copying machine, a laser-beam printer and a facsimile machine; a process cartridge having the conductive member; and an image forming apparatus having the process cartridge.

2. Description of Related Art

Conductive members are used as a charging member for applying a charging process to an image carrier (a photoconductor) and a transferring member for applying a transferring process to a toner on the image carrier in image forming apparatuses of a conventional type which uses an electrophotographic method, including electrophotographic copying machines, laser printers and facsimile machines. FIG. 10 is an explanatory diagram of an image forming apparatus which includes a charging member, and which uses an electrophotographic method of a conventional type In FIG. 10, reference numeral 300 denotes an image forming apparatus using the electrophotographic method of the conventional type. The image forming apparatus 300 using the electrophotographic method of the conventional type is configured of: an image carrier 221 on which an electrostatic latent image is formed; a charging roller 212 for performing a charging process while contacting the image carrier 211; exposing means 213 using a laser beam or the like; a developing device 220 including a toner carrier (developing roller) for adhering a toner 215 to the latent image on the image carrier 211; a transferring member (transferring roller) 216 for carrying out a process for transferring the toner image on the image carrier 211 onto a recording medium 217; and a cleaning device 221 including a cleaning member (cleaning blade) 218 for cleaning the image carrier 211 after the transfer process is completed. In FIG. 10, reference numeral 219 denotes a waste toner.

Descriptions will be provided next for how the image forming apparatus 300 using the electrophotographic method of the conventional type operates basically for forming an image.

When a DC voltage is supplied from a voltage supply (not illustrated) to the charging roller 212 which is brought into contact with the image carrier 211, the surface of the image carrier 211 is evenly charged by the charging roller 212. Once an image light is irradiated on the surface of the image carrier 211 by the exposing means 213 immediately after this charge, a potential drops depending on an amount of the light in a part of the surface of the image carrier 211 on which the image light is irradiated. The mechanism through which such a charging roller 212 charges the surface of the image carrier 211 is based on discharge in a minute interstice between the charging roller 212 and the image carrier 211. The mechanism is known as Paschen's law.

The image light represents distribution of the amount of the light, which distribution indicates changes in the amount of the light depending on black and white of the image. For this reason, once such an image light is irradiated thereon, the irradiation of the image light forms distribution of potentials depending on the amount of the image light, or an electrostatic latent image, on the surface of the image carrier 211. Once a portion in the surface of the image carrier 211 in which the electrostatic latent image is formed goes through the developing roller 214, the toner 215 adheres to the surface of the image carrier 211 depending on the distribution of potentials. Thus, the electrostatic latent image is visualized as a toner image. Thereafter, the recording medium 217 is transported by a resist roller (not illustrated), and thus is superimposed on the toner image. Hence, the toner image is transferred to the recording medium 217 by the transferring roller 216. After the toner image is transferred to the recording medium 217, the recording medium 217 is separated from the image carrier 211. The recording medium 217 thus separated is transported through a transporting channel. After the image is heated and thus fixed to the recording medium by a fixing unit (not illustrated), the resultant recording medium is discharged out of the image forming apparatus. Once the image transfer is completed in this manner, a cleaning process is applied to the surface of the image carrier 211 by the cleaning blade 218 in the cleaning device 221. Subsequently, a quenching lamp (static eliminator, not illustrated) removes residual charges from the surface of the image carrier 211, and thus makes the image carrier 211 ready for the next round of the image transferring process.

Image forming apparatuses of a type using a contact charging method in which the charging roller is brought into contact with the image carrier has been known as the image forming apparatus using such a general charging method in which the foregoing charging roller is used. The image forming apparatus using the contact charging method has been disclosed in Japanese Patent Application Laid-open Publication Numbers Sho. 63-149668 and Hei. 1-267667. Nevertheless, the image forming apparatus using the contact charging the method has disadvantages as follows.

(1) A substance constituting the charging roller is easy to adhere to the image carrier.

(2) The substance constituting the charging roller oozes from the charging roller, and accordingly adheres to the surface of the image carrier. If this condition progresses, a trace of the charging roller remains on the surface of the image carrier.

(3) When a DC voltage is applied to the charging roller, the charging roller being in contact with the image carrier vibrates. This causes charging noise.

(4) Parts of the toner on the image carrier adhere to the charging roller, and this deteriorates the charging characteristic of the charging roller. In particular, after the substance constituting the charging roller oozes therefrom as described in (2), parts of the toner is easier to adhere to the charging roller.

(5) In a case where the image carrier remains out of operation for a long period of time, a permanent deformation takes place in the charging roller.

Image forming apparatuses of a type using a proximity charging method have been disclosed as techniques for solving the foregoing problems in Japanese Patent Application Laid-open Publication Numbers Hei. 3-240076 and Hei. 4-358175. In the case of the proximity charging method, the charging roller is not in contact with the image carrier. Instead, the charging roller is caused to come closer to the image carrier with a certain gap interposed between the charging roller and the image carrier. In the case of the charging devices of this type using the proximity charging method, the charging roller is placed opposite to the image carrier in a way that the distance between the charging roller and the image carrier is equal to the closest distance (5 μm to 300 μm), and a voltage is applied to the charging roller so that the image carrier is charged. Image forming apparatuses using this proximity charging method are free from the problems with image forming apparatuses using the conventional contact charging method, such as the problem of "the adherence of the substance constituting the charging roller to the image carrier" and the problem of "the permanent deformation which takes place in the charging roller in the case where the image carrier remains out of operation for a long period of time." That is because the charging roll is not in contact with the image carrier. In addition, the image forming apparatuses using the proximity charging method are less likely to "deteriorate the charging characteristic of the charging roller due to the adherence of parts of the toner on the image carrier to the charging roller" than the image forming apparatuses using the contact charging method. That is because parts of the toner adhere to the charging roller in a smaller amount.

In the image forming apparatuses using the proximity charging method described in Japanese Patent Application Laid-open Publication Numbers Hei. 3-240076 and Hei. 4-358175, a spacer ring is provided between the two end portions of the charging roller for the purpose of maintaining a gap between the charging roller and the image carrier. Nevertheless, no arrangement is made for setting the gap accurately in these image forming apparatuses using the proximity charging method. For this reason, the charging roller and the spacer ring vary in dimensional accuracy, and the gap in between accordingly varies in clearance. This brings about a problem that charged potential is uneven and varies in the image carrier.

An image forming apparatus of a type which including tape-shaped gap maintaining means with a predetermined thickness between the charging roller and the image carrier for the purpose of solving the above-described problems has been disclosed in Japanese Patent Application Laid-open Publication No. Hei.5-107871. Nevertheless, the image forming apparatus of the type which includes the tape-shaped gap maintaining means has a problem that, if the image forming apparatus is used for a long period of time, the tape-shaped gap maintaining means wears out, and this makes it impossible for the gap between the surface of the image carrier and the surface of the charging roller to maintain a certain clearance. In addition, parts of the toner enters an interstice between the charging roller and the tape-shaped gap maintaining means, and the parts of the toner stick to the interstice due to a portion of an adhesive which has extruded from the tape-shaped gap maintaining means. This changes the thickness of the tape-shaped gap maintaining means. The changed thickness brings about a problem of making it impossible for the gap between the surface of the image carrier and the surface of the charging roller to maintain the certain clearance.

Furthermore, for the purpose of solving such a problem, Japanese Patent Application Laid-open Publication No. 2005-91818 has disclosed a charging roller including an elongate conductive supporting body constituting a shaft member, an electrical resistance adjusting layer formed on the circumferential surface of the conductive supper, and a pair of gap maintaining members provided respectively to the two ends of the electrical resistance adjusting layer in a way that the gap maintaining members are in contact with the two respective ends. In the conductive member of this type, the gap maintaining members are securely fixed to the conductive supporting body by applying an adhesive to an interstice between the conductive supporting body and each of the gap maintaining members for the purpose of enhancing the long-term reliability. However, the coefficient of linear expansion of the gap maintaining members made of a synthetic resin is largely different from the coefficient of linear expansion of the conductive supporting body made of a metal. This brings about a problem that, in a case where the charging roller is placed under a high-temperature or low-temperature condition, the conductive supporting body and the gap maintaining members are likely to be detached from each other in their interface so that the long-term reliability deteriorates slightly. In addition, the charging roller in which the adhesive is applied to the interstice between the conductive supporting body and each of the gap maintaining members has a problem that, if the charging roller is electrified for a long time, the electrification decreases the adhesive strength so that the gap maintaining members move from their initial positions, and the charging roller is easy to charge the image carrier unevenly due to the variation in the gap.

The gap maintaining members and the electrical resistance adjusting layer are made of different materials in consideration of the sticking tendency. The electrical resistance adjusting layer needs to have a tendency to cause the toner to stick to the electrical resistance adjusting layer. Accordingly, an ionic conductive agent with higher water absorption properties is used as a resistance adjuster for the electrical resistance adjusting layer. This brings about a problem that, under a high-temperature and high-humidity condition, the electrical resistance adjusting layer absorbs moisture so that the dimensions of the electrical resistance adjusting layer vary. On the other hand, the gap maintaining members need to have insulating properties and a tendency to prevent the toner from sticking to the gap maintaining members. For this reason, it is desirable that a polyolefin-based resin material be used as a resin material constituting the gap maintaining members. However, the polyolefin-based resin material is a material exhibiting less water absorption. For this reason, the amount of dimensional variation of each of the gap maintaining members is smaller than the amount of dimensional variation of the electrical resistance adjusting layer under a high-temperature and high-humidity condition. This brings about a problem of varying the gap accurately formed between the surface of the image carrier and the surface of the charging roller.

The gap accurately formed between the surface of the image carrier and the surface of the charging roller is formed on the basis of a step provided to a joint section between the electrical resistance adjusting layer and each of the gap maintaining members. The step provided to the joint section between the electrical resistance adjusting layer and each of the gap maintaining members is formed through removing processes inclusive of cutting and grinding an external portion of the electrical resistance adjusting layer and an external portion of each corresponding one of the gap maintaining members, the gap maintaining members being in pair and provided to the two respective ends of the electrical resistance adjusting layer in a way that the gap maintaining members are in contact with the two respective ends. During the removing processes inclusive of the cutting and grinding processes, burrs are easy to produce while the outside is easy to protrude, in a part of the external portion of one of the gap maintaining members at which the processes start and in the stepped portions. For this reason, when the charging roller is fitted to the image carrier, these burrs and the protrusion of the outside come between the image carrier and the charging roller. This brings about a problem of making it impossible to secure the accuracy with which the gap is maintained. Another problem occurs particularly during the removing processes inclusive of cutting and grinding the external portions of the gap maintaining members and the electrical resistance adjusting layer. When a tool cuts into workpieces, the workpieces change in shape due to the process resistance (elastically deformation). After processed, the deformed portions return to their original shape, and protrude. Yet another problem is that, due to the process resistance, chips are easy to adhere to the portion at which the processes start while burrs are easy to produce at the portion.

In addition, while the process provided to the joint section between the electrical resistance adjusting layer and each of the gap maintaining members is being processed, the tools are moved toward the center portion of the external diameters respectively of the electrical resistance adjusting layer and each of the gap maintaining members. This process imposes a heavier load on the workpieces, and accordingly brings about a problem that: burrs are easy to produce in the workpieces while chips are easy to adhere thereto. Another problem is that, while the joint section between the electrical resistance adjusting member and each of the gap maintaining members is being processed, burrs are easy to produce in the joint section while chips are easy to adhere thereto, the material of the electrical resistance adjusting member being different from the material of the gap maintaining members. Yet another problem is that the processing of the different materials affects the deterioration degree and life of each of the tools and whetstone.

SUMMARY OF THE INVENTION

An object of the present invention is to provide a conductive member, a process cartridge including the conductive member, and an image forming apparatus including the process cartridge, which have the following characteristics. A first characteristic is that, even though used for a long period of time, a gap with a certain clearance is capable of being maintained between an image carrier and a conductive member, and the surface of the image carrier accordingly capable of being charged evenly. A second characteristic is that the durability is capable of being increased. A third characteristic is that it is possible to reduce the likelihood that, while the external diameter stepped portion is being processed in the joint section between the electrical resistance adjusting layer and each of the gap maintaining members by the removing process, burrs may be produced, parts of the external diameter may extend, and chips may adhere around the processed part. A fourth characteristic is that it is possible to check reduction of the life of each tool used for the removing processes.

To achieve the above object, a conductive member according to an embodiment of the present invention is to be disposed so as to abut on an image carrier. The conductive member includes an elongate conductive supporter, an electrical resistance adjusting layer formed on a circumferential surface of the conductive supporter, and a pair of gap maintaining members provided respectively to two ends of the electrical resistance adjusting layer. Outer circumferential surfaces of the respective gap maintaining members are formed such that the outer circumferential surfaces of the respective gap maintaining members are positioned radially outward of an outer circumferential surface of the electrical resistance adjusting layer to form a gap with a certain clearance between the outer circumferential surface of the electrical resistance adjusting layer and an outer circumferential surface of the image carrier provided in parallel to the electrical resistance adjusting layer when the outer circumferential surfaces of the respective gap maintaining members abut on the outer circumferential surface the image carrier. An external diameter stepped portion which does not abut on the outer circumferential surface of the image carrier is formed in a joint section between the electrical resistance adjusting layer and each of the gap maintaining members with the joint section placed axially in a middle of the stepped portion. An inclination is formed so as to be continuously inclined from the outer circumferential surface of each of the gap maintaining members to the outer circumferential surface of the electrical resistance adjusting layer in the stepped portion.

DETAILED DESCRIPTION OF THE PREFERRED EMBODIMENTS

Descriptions will be provided hereinafter for embodiments of the present invention with reference to the drawings.

Figure 1:
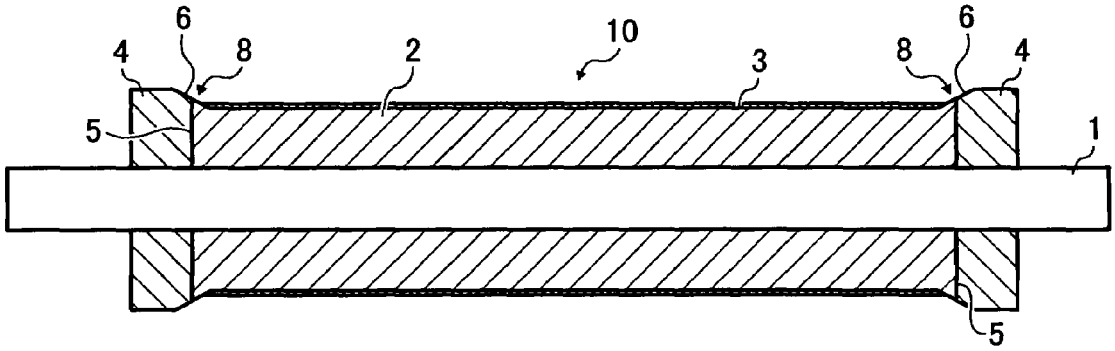
FIG. 1 is a partial, cross-sectional explanatory view of a conductive member (charging roller) according to a first embodiment of the present invention.
Figure 2:
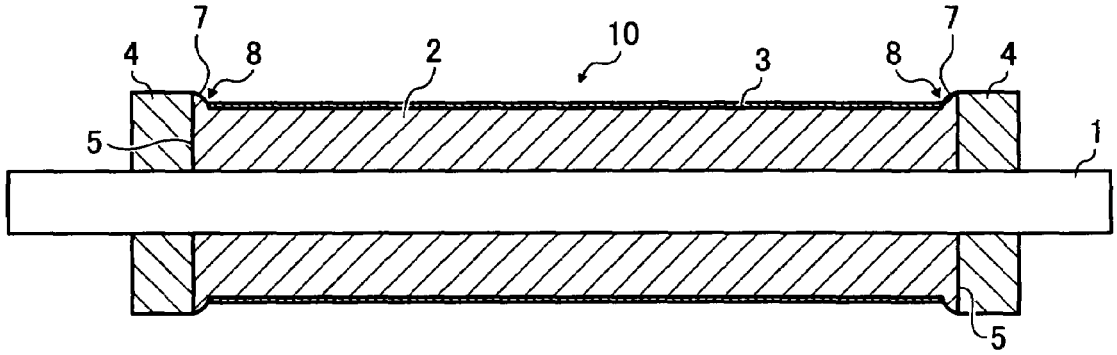
FIG. 2 is a partial, cross-sectional explanatory view of a conductive member (charging roller) according to a second embodiment of the present invention.
Figure 3:
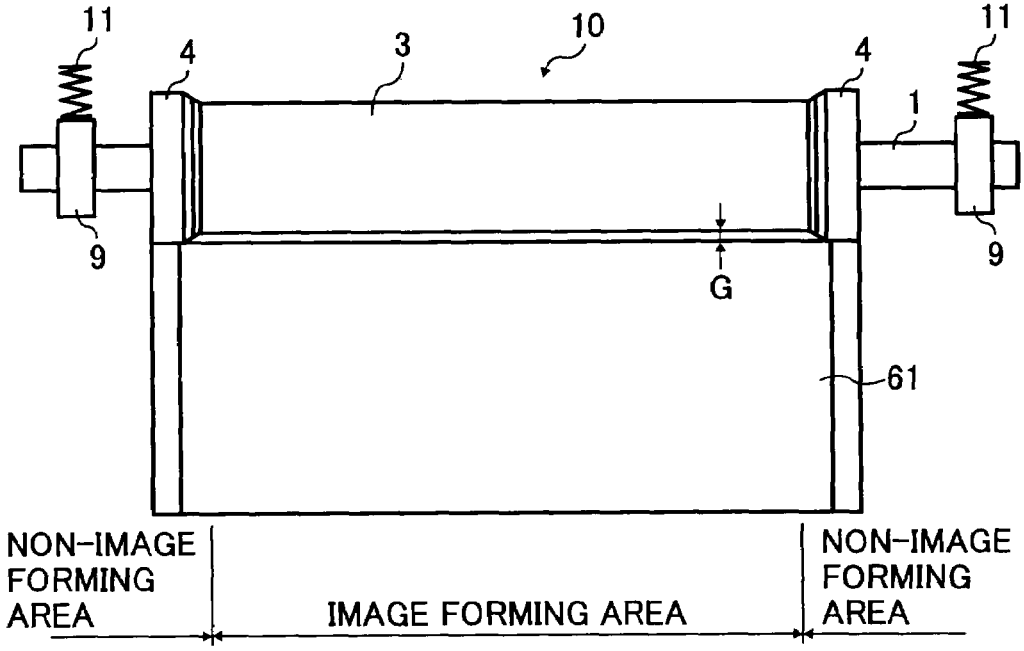
FIG. 3 is a schematic view showing how the conductive member (charging roller) according the first embodiment of the present invention is arranged above an image carrier.

In FIGS. 1 and 2, reference numeral 10 denotes a conductive member. The conductive member 10 includes: an elongate conductive supporter 1 which is, for example, in a cylindrical shape; an electrical resistance adjusting player 2 formed on the outer circumferential surface of the conductive supporter 1; and a pair of gap maintaining members 4 and 4 provided respectively to the two ends of the electrical resistance adjusting layer 2. As shown in FIG. 3, an image carrier 61 which is a non-charged body is disposed so as to abut on the conductive member 10. The each of the gap maintaining members 4 and 4 is structured such that the outer circumferential surfaces of the respective gap maintaining members 4 and 4 are positioned radially outward of the outer circumferential surface of the electrical resistance adjusting layer, that is to say, a diameter of the gap maintaining members 4 and 4 is larger than that of the electrical resistance adjusting layer. Therefore, a gap G with a certain clearance can be formed between the outer circumferential surface of the image carrier 61 and the outer circumferential surface of the conductive member 10 when the outer circumferential surfaces of the respective gap maintaining members 4 and 4 is disposed so as to abut on the outer circumferential surface the image carrier 61. In addition, an external diameter stepped portion 6 is formed in a joint section 5 between the electrical resistance adjusting layer 2 and each of the gap maintaining members 4 and 4 such that the joint section 5 is placed in the middle of the external diameter stepped portion 6. The step portion 6 does not abut on the outer circumferential surface of the image carrier 61. Furthermore, an inclination CL (a taper 7 or a chamfer 8) is formed so as to be continuously inclined from the outer circumferential surface of each of the gap maintaining members 4 and 4 to the outer circumferential surface of the electrical resistance adjusting layer 2 in the external diameter stepped portion 6.

The gap G which is accurately formed between the conductive member 10 and the image carrier 61 is required. For this reason, after the electrical resistance adjusting layer 2 and the gap maintaining members 4 are arranged on the conductive supporter 1, a removing process is applied to the external portion of each of the two members, and the stepped portion 6 is thereby formed thereon. During the removing process, burrs are easy to produce, and the external diameter are easy to partly extend, in parts of the external portion at which the cutting process starts and in the stepped portions 6. In a case where the conductive member 10 in which burrs are produced, and in which parts of the external diameter extend in the joint sections, is fitted to the image carrier 61, these burrs and the extended parts of the external diameter intervene between the conductive member 10 and the image carrier 61. This makes it impossible to keep the accuracy with which the gap G has been formed. Particularly in a case where the external portions respectively of the electrical resistance adjusting layer 2 and the gap maintaining members 4 and 4 are cut and ground with a cutting tool for the processing, it is likely that the workpieces change in shape due to the process resistance (elastically deformation), and that the deformed portions return to their original shape, and protrude, after the process. Furthermore, due to the process resistance, chips tend to adhere to, and burrs tend to be produced in, the parts at which the process starts. In addition, while the stepped portion 6 provided in the joint section 5 between the electrical resistance adjusting layer 2 and each of the gap maintaining members 4 and 4 is being processed, the tools are moved axially toward the center portion of the external portion the electrical resistance adjusting layer. This process imposes a heavier load on the workpieces. Accordingly, burrs are easy to produce in the workpieces while chips are easy to adhere thereto. Moreover, if a material of the gap maintaining members 4 and 4 is different from that of the electrical resistance adjusting layer 2, the processing of the junction section 5 between the electrical resistance adjusting layer 2 and each of the gap maintaining members 4 and 4 is apt to produce burrs, and to make chips adhere thereto. Additionally, the processing of the different materials affects the degree of deterioration, and the life, of each of the tools and whetstone.

However, In addition, the stepped portion 6 is formed in the end portion of each of the gap maintaining members 4 and 4 which are adjacent to the electrical resistance adjusting layer 2 with the joint section placed in the middle of the stepped portion 6. In the stepped portion 6, the taper 7 or the chamfer 8 is formed so as to be continuously inclined from the end portion of each of the gap maintaining members 4 and 4 to the outer surface of the electrical resistance adjusting layer 2. The foregoing configuration and formation make it possible to stably maintain the gap G between the image carrier 61 and the conductive member 10, and to evenly charge the surface of the image carrier 61, even though the conductive member 10 is used for a long period of time. This makes it possible to enhance the durability of the conductive member 10. Furthermore, the foregoing configuration and formation make it possible to reduce the amount of burrs which would otherwise be produced in, parts of the external diameter which would otherwise extend in, and the amount of chips which would otherwise adhere to, the stepped portion 6 while the stepped portion 6 is being processed. Moreover, the foregoing configuration and formation make it possible to provide the conductive member 10 capable of suppressing reduction of the life of each tool used for the removing processes.

It is desirable that a resin material used to form the gap maintaining members 4 and 4 should be a material with a lower water absorption property and a lower abrasion resistance property, because the gap G is formed between the conductive member 10 and the image carrier 61 such that the gap G can be stable for a longer period of time. In addition, it is important that the resin material used to form the gap maintaining member 4 and 4 should be a material which makes it less likely that the toner and toner additives to stick thereto, and a material which does not wear down the image carrier 61. Such a resin material is selected depending on various conditions whenever deemed necessary. Preferable examples of such a resin material includes: general-purpose resins such as polyethylene (PE), polypropylene (PP), polymethylmetacrylate (PMMA), polystyrene (PS) and polystyrene copolymers (AS and ABS); polycarbonate (PC); urethane; and fluorine.

The gap maintaining members 4 and 4 are fixed to the conductive supporter 1 with an adhesive by applying the adhesive thereto for the purpose of securing the fixing. It is desirable that the gap maintaining members 4 and 4 should be made of an insulating material, and that the value of resistance thereof should be not less than $10^{13}$ Ωcm in specific volume resistance. The reason why the gap maintaining members 4 an 4 need to have the insulating property is to prevent occurrence of a leakage current between the image carrier 61 and each of the gap maintaining members 4 and 4. The gap maintaining members 4 and 4 are formed by molding process.

In the case of the present invention, it is desirable that the specific volume resistance of the electrical resistance adjusting layer 2 should be not smaller than $10^6$, but not larger than $10^9$ Ωcm. If the specific volume resistance of the electrical resistance adjusting layer 2 is larger than $10^9$ Ωcm, the larger resistance makes the charging and transferring capabilities of the electrical resistance adjusting layer 2 smaller than necessary. Furthermore, if the specific volume resistance of the electrical resistance adjusting layer 2 is smaller than $10^6$ Ωcm, the smaller resistance causes electrical discharge from the electrical resistance adjusting layer 2 to the image carrier 61. However, if the specific volume resistance of the electrical resistance adjusting layer 2 is $10^6$ to $10^9$ Ωcm, the resistance makes it possible to secure a sufficient charging and transferring properties. Concurrently, the resistance makes it possible to prevent the occurrence of the discharge from the electrical resistance adjusting layer 2 to the image carrier 61, and to accordingly obtain an even image.

No specific restriction is imposed on the materials used to form the electrical resistance adjusting layer 2. Examples of the material include: resins such as polyethylene (PE), polypropylene (PP), polymethylmetacrylate (PMMA), polystyrene (PS) and polystyrene copolymers (AS and ABS); and thermoplastic resins such as polycarbonate (PC), polyurethane (PU) and a fluororesin. These resins are desirable, because they have better processabilities. It is desirable that a polymeric ion conductive agent to be dispersed in such a resin should be a polymeric compound containing one of polyether ester amides. Polyether ester amides are polymeric materials each with ion conductivity, and are evenly dispersed and fixed in a matrix polymer at the molecular level. For this reason, a composition obtained by dispersing the conductive agent containing a polyether ester amide in the foregoing resin do not vary the electrical resistance value, which would otherwise vary due to an inadequate kneading the mixture of the materials by use of a biaxial kneader, another type of kneader or the like. The electrical resistance adjusting layer 2 is formed on the conductive supporter 1 by coating the conductive supporter 1 with the semiconductor resin composition by use of extrusion molding means, injection molding means or the like. In addition, a needed accuracy of the surface of the electrical resistance adjusting layer 2 is capable of being obtained through a process of cutting or grinding the surface in an arbitrary step.

When the conductive member 10 is configured so as to form only the electrical resistance adjusting layer 2 on the conductive supporter 1, the performance is deteriorated through adherence of the toner or the like to the surface of the electrical resistance adjusting member 2 in some cases. However, the forming of a surface layer 3 on the electrical resistance adjusting layer 2 makes it possible to prevent such a trouble from occurring. In the case of the present invention, it is preferable that the specific volume resistance of the surface layer 3 should be set larger than that of the electrical resistance adjusting layer 2. If the specific volume resistance of the surface layer 3 is set larger than that of the electrical resistance adjusting layer 2 in this manner, this setting makes it possible to prevent abnormal discharge from occurring due to a voltage concentrated on defective parts in the photoconductor. If, however, the specific volume resistance of the surface layer 3 is set too high, this setting makes the charging and transferring capabilities of the electrical resistance adjusting layer 2 smaller than necessary. For this reason, it is desirable that the difference in electric resistance dispersion, unlike a composition obtained by dispersing a conductive agent, such as a metallic oxide and carbon blacks. In addition, bleedout is hard to occur because polyether ester amides are polymeric materials. In order to set the electrical resistance value at a predetermined value, it is desirable that the amount of a thermoplastic resin to be mixed should be 20 to 70% by weight, and that the amount of a polymeric ion conductive agent to be mixed should be 80 to 20% by weight.

An electrolyte (electrolytic salt) may be added thereto for the purpose of adjusting the resistance value. Examples of the electrolytic salt include: alkali metal salts such as sodium perchlorate and lithium perchlorate; quaternary phosphonium salts such as ethyltriphenyl phosphonium-tetrafluoroborate and tetraphenyl phosphonium-bromide. A conductive agent may be used solely, or multiple conductive agents may be used by blending, as long as such a use does not deteriorate the properties. For the purpose of evenly dispersing the conductive agent(s) in the matrix polymer, the conductive agent(s) may be micro-dispersed therein by adding a compatibilizer in the matrix polymer whenever deemed necessary. Examples of the compatibilizer include what contains a glycidyl methacrylate group as a reaction group. Additives such as antioxidants may be used as long as such a use does not deteriorate the properties.

The resin composition constituting the electrical resistance adjusting layer 2 is capable of being easily produced by melting and value between the surface layer 3 and the electrical resistance adjusting layer 2 should be not larger than $10^3$ Ωcm. It is preferable that a material used to form the surface layer 3 should be a resin such as a fluoride-based resin, a silicone-based resin, polyamide resin or polyester resin. Because these resins have a better non-adhesive property, it is desirable that these resins should be used from the viewpoint of preventing the toner from adhering to the surface layer 3. Furthermore, because these resins are electrically insulating, the dispersing of conductive agents in any one of these resins makes it possible to adjust the electrical resistance of the surface layer 3. The surface layer 3 is formed on the electrical resistance adjusting layer 2 in the following manner. First of all, a resin material used to form the surface layer 3 is dissolved in an organic solvent. Thereby, a coating is produced. The electrical resistance adjusting layer 2 is coated with this coating by spray coating, dipping, roll coating or the like. It is desirable that the surface layer 3 should be 10 to 30 μm in thickness.

Any one of a single type or a binary type of liquid coating may be used as a coating used to form the surface layer 3. If a binary type of liquid coating in which a curing agent is used along with a base agent is employed, this employment makes it possible to enhance the environmental resistance, non-adhesive property, and mold release property of the surface layer 3. In a case where the binary type of liquid coating is employed, a general practice is to heat the coated film, thereby crosslinking and hardening the resin constituting the coated film. However, the coated film can not be heated at a high temperature, because the electrical resistance adjusting layer 2 is formed of the thermoplastic resin. For this reason, used is a binary type of liquid coating which is made of a base agent containing a hydroxyl group in its molecule along with an isocyanate-based resin allowing a crosslinking reaction and curing reaction to take place at a relatively low temperature of not higher than 100° C. Examples of such isoyanate-based resin include polyisocyanate resins. Specific examples of the polyisocyanate resins include 2, 4-tolylene diisocyanate, diphenylmethane-4, 4'-diisocyanate, a xylylene diisocyanate, an isophorone diisocyanate, lysine methyl ester diisocyanate, methyl cyclohexyl diisocyanate, trimethyl hexamethylene diisocyanate, a hexamethylene diisocyanate, n-pentane (1), 4-diisocyanate, their trimers, their adducts, their burettes, their polymers having two or more isocyanate groups, and blocked isocyanate. However, polyisocyanate resins to be used are not limited to these examples. With regard to the amounts of ingredients mixed in the curing agent, the equivalent weight ratio of the curing agent to the functional group (—OH group) is within a range of 0.1:1 to 5:1, preferably within a range of 0.5:1 to 1.5:1. In addition, a curing agent made of an amino resin such as a melamine resin or a guanamine resin may be used depending on the heat resisting properties of the base material whenever deemed necessary.

What is an important factor of the conductive member 10 is its electrical characteristic. It is necessary that the surface layer 3 should be conductive. The conductivity of the surface layer 3 is formed by dispersing a conductive agent in the resin material used to form the surface layer 3. No specific restriction is imposed on the conductive agent. Examples of the conductive agent include: conductive carbons such as a Ketjen black EC and an acetylene black; carbons for rubber such as SAF (Super Abrasion Furnace), ISAF (Intermediate SAF), HAF (High Abrasion Furnace), FEF (Fast Extruding Furnace), GPF (General Purpose Furnace), SRF (Semi-Reinforcing Furnace), FT (Fine Thermal), MT (Medium Thermal); carbons for color to which an oxidation treatment or the like has been applied; pyrolytic carbon; tin oxide doped with indium (ITO); metal single bodies such as copper, silver and germanium; metal oxides such as tin oxide, titanium oxide and zinc oxide; and conductive polymers such as polyaniline, polypyrrole and polyacetylene. As the conductivity-imparting agents, there may be used ionic conductive agents.

Examples of the ionic conductive agents include: inorganic ionic conductive substances such as sodium pechlorate, lithium perchlorate, calcium perchlorate and lithium chloride; and organic ionic conductive substances such as aliphatic acid-modified dimethylammonium ethosulfate, ammonium stearate acetate, lauryl ammonium acetate. The conductive agents may be used singly or in combination by blending, as long as such a use does not deteriorate the properties. The conductive agents can be dispersed in the resin material by use of a publicly-known method using a dispersing medium such as glass beads or zirconia beads in a ball mill, paint shaker or beads mill.

Figure 4:
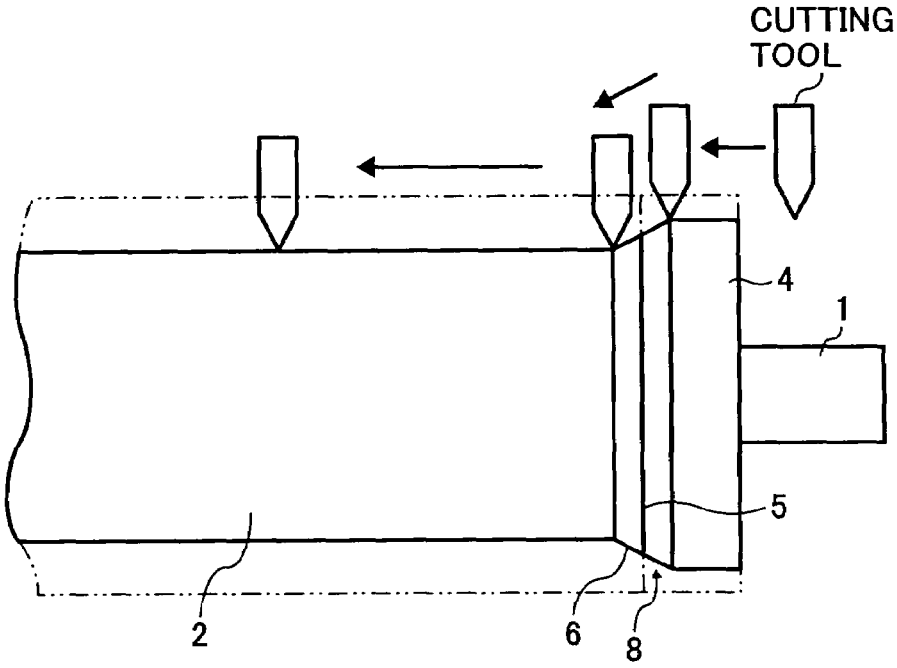
FIG. 4 is an explanatory view showing how a removing process is applied to the conductive member (charging roller) according to the first embodiment of the present invention.
Figure 5:
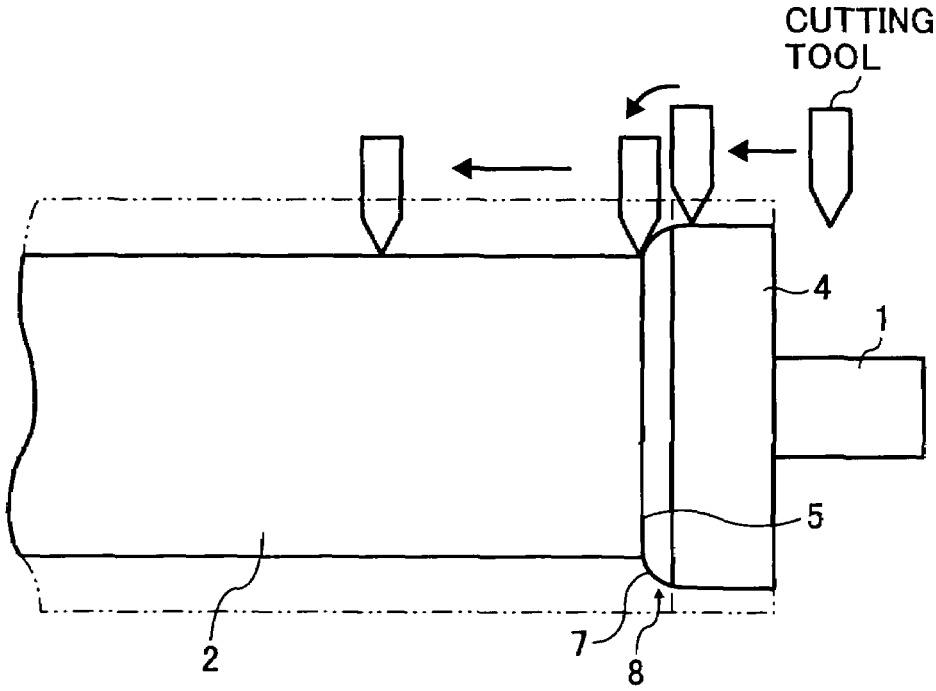
FIG. 5 is an explanatory view showing how another removing process is applied to the conductive member (charging roller) according to the first embodiment of the present invention.

The taper 7 and the chamfer 8 in each of the stepped portion 6 are formed by the removing process such as the cutting process and the grinding process, as shown in FIGS. 4 and 5. The taper 7 and the chamfer 8 are efficiently formed with high accuracy by the removing process such as the cutting process and the grinding process.

In the case of the present invention, an external portion starts to be cut in the end surface of a first one of the gap maintaining members 4, as shown in FIGS. 4 and 5. Subsequently, part is cut away from the external portion with the cutting tool in a gradually-increasing amount (gradually deeply) as the cutting tool moves from the gap maintaining member 4 to the electrical resistance adjusting layer 2 while crossing over the boundary portion between the gap maintaining member 4 and the electrical resistance adjusting layer 2, or the corresponding joint section 5. Thereby, a corresponding one of the stepped portions 6 is provided. FIG. 4 shows an example of how the taper 7 is formed, and FIG. 5 shows an example of how the chamfer 8 is formed. Thereafter, the cutting process is applied to the electrical resistance adjusting layer 2. For the purpose of maintaining the accuracy with which the step between the electrical resistance adjusting layer 2 and each of the gap maintaining members 4 and 4 is formed, the amount of the part cut away with the cutting tool is corrected depending the necessity while processing the electrical resistance adjusting layer 2 which is an elongate member. In order to provide the other stepped portion 6 to a second gap maintaining member 4 which is located opposite to the first gap maintaining member 4 in which the process has started, part is cut away from the corresponding external portion with the cutting tool in a gradually-decreasing amount (gradually narrowly) as the cutting tool moves from the electrical resistance adjusting layer 2 to the second gap maintaining member 4 while crossing over the other joint section 5. Afterward, the second gap maintaining member 4 is cut to a predetermined external diameter. If the taper 7 or the chamfer 8 is formed with the joint section 5 between each gap maintaining member 4 and the electrical resistance adjusting layer 2 placed in the middle of the taper 7 or the chamfer 8, the different materials are continuously cut even though the gap maintaining member 4 and the electrical resistance adjusting layer 2 are formed respectively of the different materials. This makes it easy for chips to continue, and to accordingly enhance the efficiency with which the chips are discharged. Particularly in a case where an interstice exists between the different materials, it is desirable that the process should be performed while moving the cutting toll in the interstice portion. That is because parts of the chips would otherwise be trapped in the interstice so that the parts of the chips are easy to adhere around the interstice.

In the case of this type of cutting process, the smaller the nose R is made, the more accurately the above-described chamfering process can be performed. It is apprehended, however, that the faster the feeding speed of the cutting tool is set, the larger the roughness Rz of the processed surface becomes. For this reason, in a case where the roughness Rz of the processed surface in the electrical resistance adjusting layer 2 needs to be at a level of not larger than 5 μm, it is necessary that the nose R should be not smaller than 2, or that the nose R should be not larger than 1 while the feeding speed should be decreased to 0.1 mm/rev. It is preferable that the cutting process should be performed with a NC (Numeric Control) program. Preferably, conditions for the cutting process are (1) that a cutting tool to be used should be a diamond point tool (sintered diamond/grain size, #1600/nose, R=3/clearance angle, 3°/rake angle, 30°), and (2) that the process should be performed with the process conditions (number of revolutions, 3000 rpm/cutting margin, ϕ0.8/feeding speed of the cutting tool, 0.2 mm/rev).

It is preferable that the chamfer 8 should be that convex outward or inward. If the chamfer 8 is that convex outward or inward as described above, this makes it possible to relax the stress concentrated on a portion in which the image carrier 61 abuts on each of the outer diameter stepped portions 6, and to accordingly enhance the durability. The curvature radius R of the chamfer is not larger than 50 μm if the step of each of the stepped portions 6 is at a level of 100 μm. If, however, the step of each of the stepped portions 6 is not larger than 50 μm, this makes it impossible to perform the chamfering process due to its processing accuracy (resolution). For this reason, it is desirable that the chamfering process should be applied thereto when the step of each of the stepped portions 6 is larger than that.

In the case of the present invention, the conductive member 10 is a charging roller. If a conductive member is used as the charging roller in this manner, this makes it possible to prevent the charging roll from becoming unclean or the like. Concurrently, the forming of the charging roller of a hard material makes it possible to construct the charging roller with high accuracy, and to accordingly prevent the image carrier 61 from being unevenly charged.

No specific restriction is imposed on the form of the conductive member (charging roller) 10 according to an example of the present invention. The conductive member (charging roller) 10 may be arranged and fixed there in the shape of a belt, blade (plate) or semicircular column. In addition, the conductive member (charging roller) 10 may be formed in the shape of a column, and the two ends thereof may be thus rotatably supported by gears or bearings, respectively. If the conductive agent (charging roller) 10 is formed including curved surfaces which gradually become distant away from the respective portions closest to the image carrier 61 in a direction in which the image carrier 61 rotates, this makes it possible to charge the image carrier 61 evenly. If there exists a pointed portion on the conductive member (charging roller) 10 facing to the image carrier 61, the electrical potential of the pointed portion is higher than any other portion thereon so that an electrical discharge starts at the pointed portion earlier than at any other portion thereon. This discharge makes it difficult to evenly charge the image carrier 61. For this reason, in the case of the present invention, the conductive member (charging roller) 10 is cylindrical. In the case where the conductive member (charging roller) 10 is cylindrical, this makes it possible to cause the conductive member 10 to be driven to rotate, and to accordingly prevent the electrical discharge from continuing in the single portion. This prevention makes it possible to reduce chemical deterioration of the surface which would otherwise take place due to the continuous electrical discharge in the single portion, and to accordingly extend the life (durable period) of the conductive member (charging roller) 10.

Figure 9:
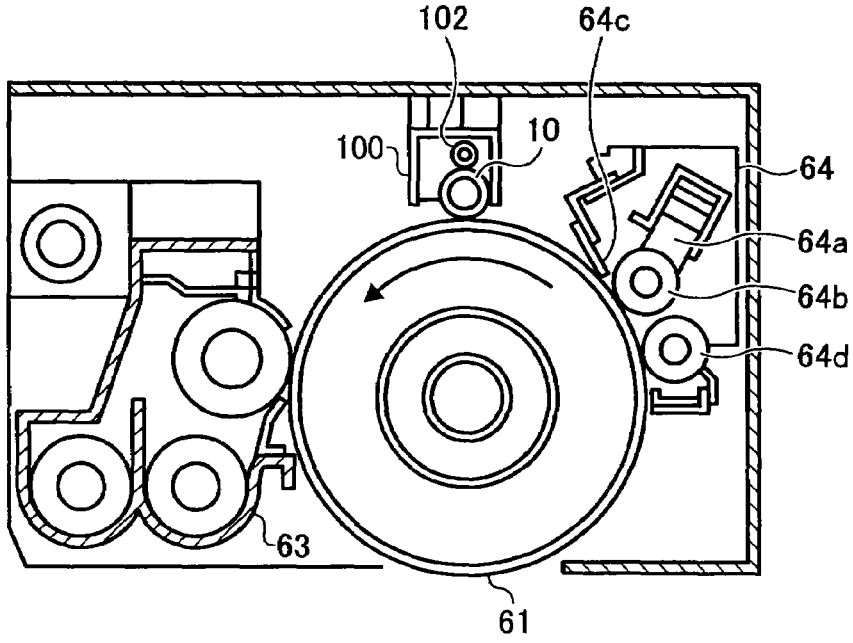
FIG. 9 is an explanatory view of a process cartridge according to the first embodiment of the present invention.
Figure 10:
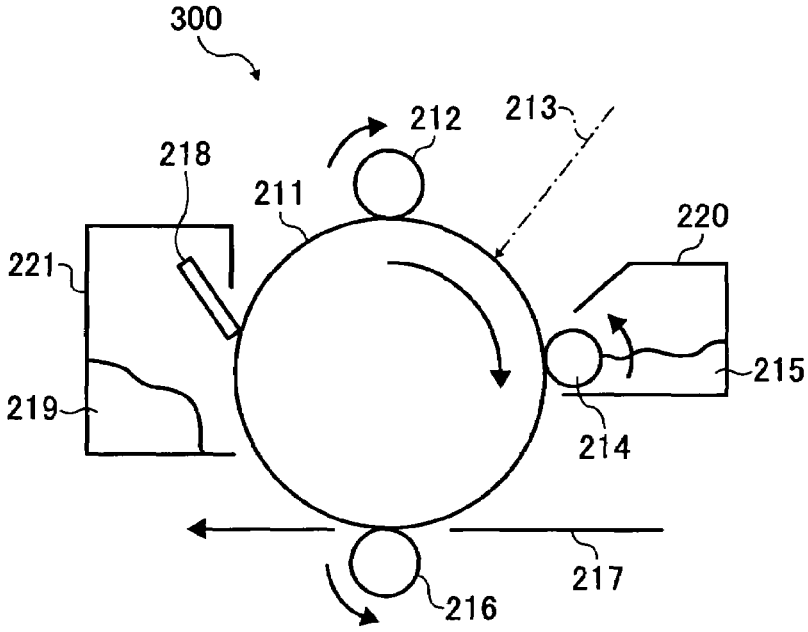
FIG. 10 is an explanatory view of an image forming apparatus using an electrophotographic method of the conventional type.

FIG. 9 shows an example of a process cartridge including a charging device having the conductive member (charging roller) of this kind. As shown in FIG. 9, the charging device 100 includes a cleaning member 102 for removing stains from the conductive member (charging roller) 10. A roller shape, pad shape and the like are available as the shape of the cleaning member 102. In the case of the present invention, the cleaning member 102 is a roller shape. The cleaning member 102 is fitted into a bearing provided to a housing (not illustrated) in the charging device 100, and the shaft of the cleaning member 102 is rotatably supported by the bearing. This cleaning member 102 abuts on the conductive member (charging roller) 10, and thus cleans the surface of the conductive member (charging roller) 10. Once foreign matters such as a toner, paper dust, broken pieces of the members adhere to the conductive member (charging roller) 10, the electrical field concentrates on the foreign matters. This causes an abnormal discharge to take place in portions on which the electrical field concentrates. By contrast, if electrical insulating foreign matters adhere to a wider area on the conductive member (charging roller) 10, no discharge takes place in the area. This makes it impossible to charge the image carrier 61 evenly. For this reason, it is desirable that the charging device 100 should be provided with the cleaning member 102 for cleaning the surface of the conductive member (charging roller) 10. A brush of fibers made of polyester or the like, a porous material (sponge) made of a melamine resin or the like, or their equivalent may be used as the cleaning member 102. In addition, the cleaning member 102 may rotate in conjunction with the rotation of the conductive member (charging roller) 10, or may perform intermittent operations with an alternate series of rotations and detachments.

Furthermore, the charging device 100 includes a voltage supply (not illustrated) for applying a voltage to the conductive member (charging roller) 10. The applied voltage may be only a DC voltage. It is desirable, however, that the applied voltage should be a voltage obtained by superimposing a DC voltage and an AD voltage on each other (hereinafter referred to as a "superimposed voltage"). If only the DC voltage is applied to the conductive member (charging roller) 10 in a case where the layer formation of the conductive member (charging roller) 10 is partially uneven, the electrical potential of the surface of the image carrier 61 is uneven in some cases. On the other hand, in the case where the superimposed voltage is applied to the conductive member (charging roller) 10, the electrical potential of the surface of the conductive member (charging roller) 10 is even. This stabilizes the electrical discharge, and accordingly makes it possible to charge the image carrier 61 evenly. It is desirable that the interpeak voltage of the AC voltage in the superimposed voltage should be set more than twice as large as a voltage with which the image carrier 61 starts to be charged. In this respect, the voltage with which the image carrier 61 starts to be charged means an absolute value of a voltage which is applied to the image carrier 61 when the image carrier 61 starts to be electrically charged. Once the image carrier 61 is electrically charged, a reverse discharge takes place from the image carrier 61 to the conductive member (charging roller) 10. A smoothing effect of the reverse discharge makes it possible to evenly charge the image carrier 61 in a more stable condition. Moreover, it is desirable that the frequency of the AD voltage should be set more than 7 times as large as the circumferential speed of the image carrier 61. If the frequency of the AD voltage is set more than 7 times as large as the circumferential speed of the image carrier 61, this makes it possible to eliminate an image with moiré interference patterns.

As shown in FIG. 3, the charging device 100 according to the example of the present invention includes at least: the conductive member (charging roller) 10 arranged so as to face the image carrier 61 with the fine gap G provided in between; the cleaning member 102 (its illustration is omitted in FIG. 3) for cleaning the conductive member (charging roller) 10, the voltage supply (not illustrated) for applying the voltage to the conductive member (charging roller) 10; and a biasing spring for pressing and thus bringing the conductive member (charging roller) 10 into contact with the image carrier 61. As shown in FIGS. 3 and 9, the conductive member (charging roller) 10 is arranged so as to face the image carrier 61 with the fine gap G. The gap G between the conductive member (charging roller) 10 and the image carrier 61 is formed by causing the gap maintaining members 4 and 4 to abut on corresponding non-image forming areas (non-photosensitive layer areas) provided respectively to the two ends of the conductive member (charging roller) 10. By causing the gap maintaining members 4 and 4 to abut on the respective non-image forming areas, the variation in the gap G is capable of being prevented even though the photosensitive layer varies in coating thickness. The surface layer 3 is formed on the electrical resistance adjusting layer 2 of the conductive member (charging roller) 10 in order that it can be hard for the toner and the toner additives to adhere to the surface thereof.

The gap G between the conductive member (charging roller) 10 and the image carrier 61 is set to be not more than 100 μm in clearance, particularly within a range of approximately 5 to 70 μm in clearance. This setting makes it possible to check an image from being deteriorated when the charging device 100 operates. In a case where the gap G is more than 100 μm in clearance, the voltage with which the discharge starts in accordance with Paschen's law becomes larger so that corona products such as ozone and NOx are produced in a larger amount when the image carrier 61 is charged to a predetermined extent. These corona products remain in a large amount in the discharge space after an image is formed, and thus adhere to the surface of the image carrier 61, accordingly oxidize the surface of the image carrier 61. This is a cause of accelerating deterioration of the image carrier 61 with time. On the other hand, in a case where the gap G is smaller, the image carrier 61 is capable of being charged by use of a smaller discharged energy. However, in the case where the gap G is smaller, this worsens the air flow so that corona products produced in the discharge space remain in the discharge space after an image is formed. For this reason, the corona products adhere to the surface of the image carrier 61, and are accordingly a cause of accelerating deterioration of the image carrier 61 with time, in common with the case where the gap G is larger. With this taken into consideration, it is preferable that the gap G should have a clearance which makes the discharged energy small enough for the corona products to be produced in a smaller amount, and which concurrently causes the air not to remain there. For instance, it is preferable that the gap G be set not larger than 100 μm in clearance, particularly within a range of 5 to 70 μm in clearance. This setting makes it possible to prevent an image from being deteriorated due to the generation of the corona products.

Part of the toner which remains in the surface of the image carrier 61 after the toner image is transferred to the recording medium is removed by a cleaning device 64 (see FIG. 9) provided opposite to the image carrier 61. However, it is impossible for the cleaning device 64 to remove the part of the toner completely. As a result, an extremely small amount of the toner goes through the cleaning device 64, and thus is transported to the charging device 100. At this time, if the grain size of the toner is larger than the clearance of the gap G, particles of the toner are rubbed by the image carrier 61 and the conductive member (charging roller) 10 which rotate, and are thus heated. In some cases, the particles of the toner are fused, and thus adhere to the conductive member (charging roller) 10. In a case where the part of the toner is fused and adheres thereto, this fused adhesion makes the gap G between the conductive member (charging roller) 10 and the image carrier 61 narrower so that an abnormal discharge takes place. With this taken into consideration, it is desirable that the clearance of the gap G is larger than the grain size of the toner to be used for the image forming apparatus 1.

In addition, as shown in FIG. 3, the conductive member (charging roller) 10 is fitted into a bearing 9 which is provided to a side plate of the housing (not illustrated) in the charging device 100, and which is formed of a resin with a small coefficient of friction. The pressing springs 11 press the conductive member (charging roller) 10 toward the surface of the image carrier 61. This makes it possible to maintain the gap G constant even with mechanical vibration, or even though the center axis of the conductive member (charging roller) 10 deviates from the normal position. There are some cases that no matter how the conductive member (charging roller) 10 is fixed by the bearing 9, the gap G moves so that the clearance of the gap G goes out of the adequate range in some cases, because the conductive member (charging roller) 10 vibrates while rotating, because the center axis thereof deviates from the normal position, or because the surface thereof undulates. In these cases, an abnormal discharge as described above takes place. This accelerates the deterioration of the image carrier 61. Otherwise, this causes corona products to remain in the discharge space so that an image is deteriorated. With these problems taken into consideration, these problems are avoided by causing the pressing springs 11 to press the conductive member (charging roller) 10 toward the image carrier 61, and by thus maintaining the gap G with the certain clearance. At this point, let us discuss load on the image carrier 61 via the gap maintaining members 4 and 4. The load is capable of being adjusted by the force of the pressing springs 11 provided respectively to the two ends of the conductive member (charging rollers) 10, the dead load of each of the conductive member (charging roller) 10 and the cleaning member 102, and the like. If the load is smaller, it is impossible to suppress the conductive member (charging roller) 10 from changing in position while rotating, and to suppress the conductive member (charging roller) 10 from changing in position due to an impact of gears in driving operation and the like. On the other hand, if the load is larger, this increase the friction between the conductive member (charging roller) 10 and the bearing 9 into which the conductive member (charging roller) 10 is fitted. This friction increases the amount of abrasion of the conductive member (charging roller) 10 and the bearing 9 with time, and accordingly accelerates the deviation of the center axis of the conductive member (charging roller) 10 from the normal position. With these taken into consideration, it is preferable that the load should be set within a range of 4 to 25N, particularly within a range of 6 to 15N. Through this setting, the gap G is set within the adequate range. Thereby, the surface of the image carrier 61 is suppressed from deteriorating due to the abnormal discharge, and an image is prevented from be disturbed due to corona products.

FIG. 9 shows a process cartridge including the conductive member 10 according to the example of the present invention. The process cartridge includes at least the charging device 100, the image carrier 61 and the cleaning device 64. A development device 63 may be included in the process cartridge, as shown in FIG. 9. The process cartridge is an integrated unit, and is freely attached to, and detached from, the image forming apparatus. In the case of the process cartridge including the conductive member 10 according to the example of the present invention, an image forming area on the surface of the image carrier 61 is evenly charged by the conductive member (charging roller) 10, which is arranged with the certain gap G provided between the conductive member (charging roller) 10 and the surface of the image carrier 61. Thereby, an electrostatic latent image is formed on the surface of the image carrier 61. Thereafter, the electrostatic latent image on the surface of the image carrier 61 is turned into a toner image by use of the toner, and thus is visualized. Subsequently, the visualized toner image is transferred to a recording medium. Part of the toner is not transferred to the recording medium, and remains on the surface of the image carrier 61. This part of the toner is collected by a cleaning member 64*c* of the cleaning device 64. Thereafter, for the purpose of preventing the toner and the toner ingredients from adhering to the surface of the image carrier 61, a coating member 64*b* evenly coats the surface of the image carrier 61 with a solid lubricant 64*a*, and thus forms a lubricant layer. Afterward, part of the toner which the cleaning member 64*c* has not been capable of collecting completely is collected by an auxiliary cleaning member 64*d*, and is thus transported to a waste toner collecting unit provided to the cleaning device 64. Examples of the cleaning member 64*c* include: a rubber blade made of silicon, urethane or the like; and a fur brush made of polyester fibers or the like. The auxiliary cleaning member 64*d* is formed in the shape of a roller, a brush or the like. The solid lubricant 64*a* may be an aliphatic metallic salt such as zinc stearate, polytetrafluoroethylene, or the like as long as it is capable of decreasing the coefficient of friction of the image carrier 61, and of causing the surface of the image carrier 61 to exhibit a non-adhesive property.

In the case where the process cartridge including the conductive member 10 according to the example of the present invention as described above, this use makes it possible to obtain a stable image quality for a long period of time. In addition, it is easy to replace a used process cartridge with a new one. The process cartridge makes user's maintenance easier.

Figure 7:
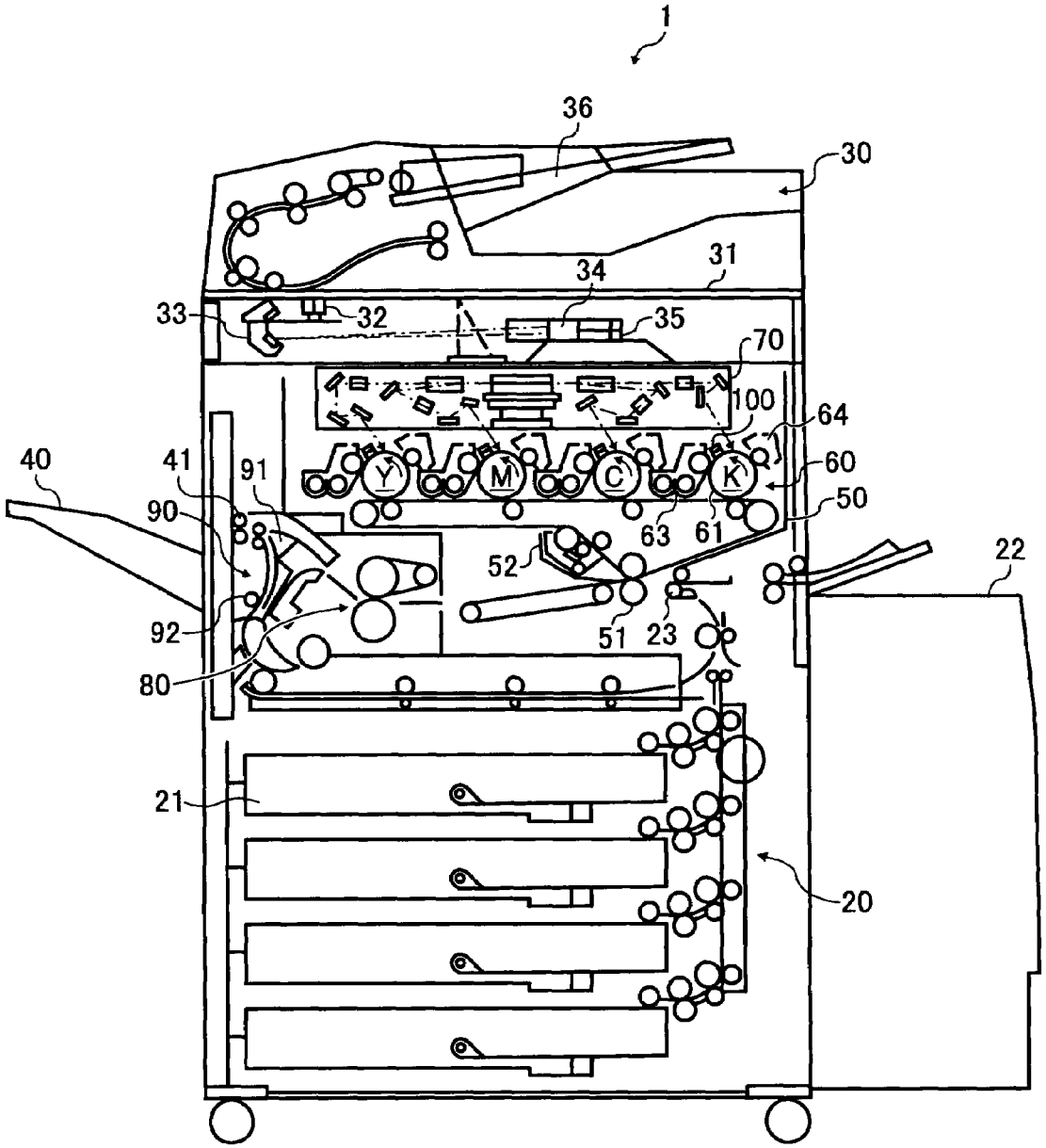
FIG. 7 is an explanatory view of an image forming apparatus according to the first embodiment of the present invention.
Figure 8:
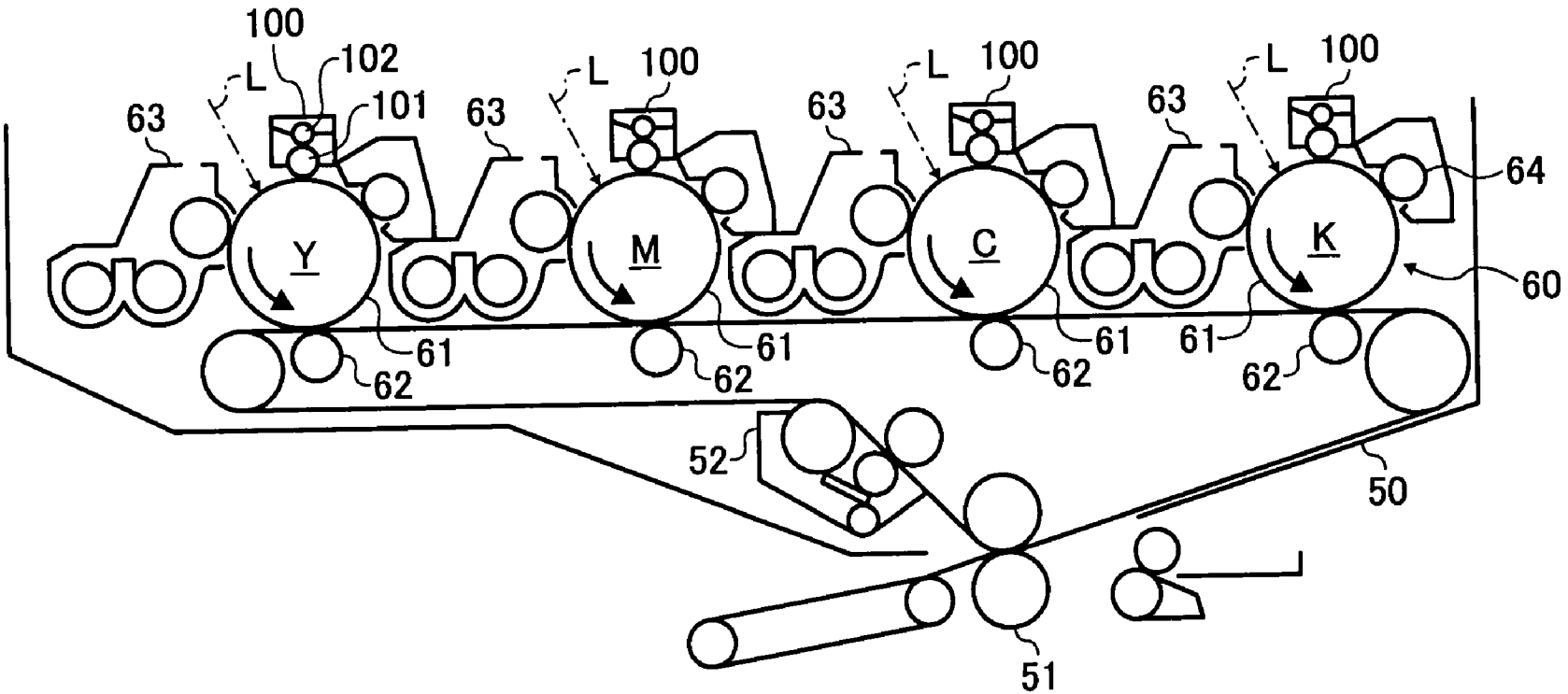
FIG. 8 is an explanatory view of an image forming section in the image forming apparatus shown in FIG. 7.

FIGS. 7 and 8 show an example of an image forming apparatus according to the present invention. The image forming apparatus according to the example of the present invention includes: four drum-shaped image carriers 61 corresponding respectively to four colors of yellow (Y), magenta (M), cyan (C) and black (K); charging devices 100, provided respectively to the image carriers 61, for evenly charging the respective image carriers 61; four exposure devices 70 for forming their respective electrostatic latent images by exposing their corresponding charged image carriers 61 to light; four development devices 63 which contain their respective toners representing the four colors of yellow, magenta, cyan and black as well as their respective developers, and which form their respective toner images corresponding to the electrostatic latent images on the image carriers 61; four primary transfer devices 62 for transferring the corresponding toner images on the respective image carriers 61; an intermediary transfer body 50 which is shaped like a belt, and to which the toner images on the respective image carriers 61 are transferred; a secondary transfer device 51 to which the toner images on the intermediary transfer body 50 are transferred; a fixing device 80 for fixing the toner images on the intermediary transfer body 50 which have been transferred to a recording medium; and cleaning devices 64 for removing part of the toners remaining on their respective image carriers 61 after their corresponding toner images are transferred to the recording medium. Recording media are transported one-by-one on a transporting channel by use of transportation rollers to resist rollers 23 from any one of sheet feeders 21 and 22 containing the recording media. In this occasion, each recording medium is transported in synchronism with the rotations of the respective image carriers 61 in order that the toner images on the image carriers 61 can be transferred respectively to adequate positions on the recording medium.

The exposure device 70 in the image forming apparatus 1 includes a light source (not illustrated). Light L is irradiated on the image carriers 61 charged by the respective charging devices 100, and thus an electrostatic latent image is formed on each of the image carriers 61. The light source may be a lamp such as a fluorescent lamp or a halogen lamp, an LED (light emitting diode), a laser beam from a semiconductor device such as an LD (laser diode), or the like. In this case, the LD is used as the light source. The light L is irradiated in synchronism with the rotational speed of each of the image carriers 61 on a basis of a signal from an image processor, which is not illustrated.

In each of the development devices 63, a toner stored in the development device 63 is transported by supplying rollers to an agitation unit, where the transported toner and a developer are mixed together and agitated. Subsequently, the mixture is transported to an area (development area) opposite to the image carrier 61 above a developer carrier (its illustration is omitted) in the development device 63. The toner, which is charged with a positive or negative polarity, is transferred to the electrostatic latent image on the image carrier 61, followed by a development. The developer may be a developer made of a single magnetic or nonmagnetic ingredient, a developer obtained by using both a magnetic ingredient and a non-magnetic ingredient, or a liquid developer of a wet type.

In each of the primary transfer devices 62, an electric field with a polarity opposite to that of the toner is formed. The developed toner image on each of the image carriers 61 is transferred to the back side of the intermediary transfer body 50. The primary transfer device 62 may be a corona transfer device including a corona charging device such as a corotron or a scorotron, or a transfer device using transfer rollers and transfer brushes, or the like.

Thereafter, in synchronism with a recording medium transported from one of the sheet feeders 21 and 22, each toner image on the back side of the intermediary transfer body 50 is transferred to the recording medium by the secondary transfer device 51. It should be noted that, instead of using the intermediary transfer body 50, the toner image on the surface of each of the image carriers 61 may be directly transferred to the recording medium.

The fixing device 80 fixes each toner image, which is on the recording medium, to the recording medium by heating and pressing. When the recording medium goes between a pair of heating/fixing rollers, the recording medium is heated and pressed, and a binding resin in the toner is fused. Thereby, each toner image is fixed onto the recording medium. The fixing device 80 may be that of a belt type instead of that of the roller type. Otherwise, the fixing device 80 may be that of a type which fixes toner images to a recording medium through thermal irradiation by using a halogen lamp or the like.

The cleaning device 64 for each of the image carriers 61 removes part of the toner which has not been transferred to the recording medium, and which accordingly remains on the image carrier 61. Thereby, the cleaning device 64 enables a new toner image to be formed. The cleaning device 64 may be of a blade type which uses rubber made of urethane or the like, or of fur brush type which uses fibers made of polyester or the like.

Descriptions will be provided for how the image forming apparatus 1 operates according to the example of the present invention. First of all, an operator sets an original on an original table in a reading section 30. Otherwise, the operator opens an original transporting unit 36 in the reading section 30, sets an original on a contact glass 31, closes the original transporting unit 36, and thereby presses down the original. Once the operator pushes the start switch, which is not illustrate, the original is transported to the top of the contact glass 31 in the case where the original has been set in the original transporting unit 36. On the other hand, in the case where the original has been set on the contact glass 31, a first reading carriage 32 and a second reading carriage 33 start to run immediately. A light source provided to the first reading carriage 32 is lit, and light is irradiated on the original. Light reflected off the surface of the original is guided to an image forming lens 34 via the second reading carriage 33. Thereby, an image representing the original is formed on a CCD (Charge-Coupled Device) 35, which is a reading sensor. Information on the image which is read by the CCD 35 is transferred to a control unit, which is not illustrated. On the basis of the information on the image which the control unit receives from the reading section 30, the control unit controls a light source (not illustrated) placed in the exposure device 70 in an image forming section 60, and thereby directs the light source to a corresponding one of the image carriers 61, hence causing the light source to irradiate light L on the image carrier 61 (see FIG. 8). Through this irradiation, an electrostatic latent image is formed on the surface of the image carrier 61.

A developer to which the toner adheres due to an electrostatic force is attracted to, and held in, a corresponding one of the development devices 63. Thereby, what is termed as a magnetic brush is formed on the developer carrier 65. A development bias voltage applied to the developer carrier 65 transfers the developer, to which the toner has been adhered, to the image carrier 61. By this, the electrostatic latent image which has been formed on the surface of the image carrier 61 is visualized. Thus, a toner image is formed. The development bias voltage is that obtained by superimposing the AC voltage and the DC voltage.

Subsequently, the intermediary transfer body 50 is transported by a drive motor (not illustrated) and supporting rollers 66. Simultaneously, in the image forming units corresponding respectively to the black, yellow, magenta and cyan colors, the corresponding image carriers 61 are rotated. Thus, black, yellow, magenta and cyan toner images are formed on the respective image carriers 61. Afterward, the resist rollers 23 transport the intermediary transfer body 50 once again. Thereby, the toner images representing the respective colors are sequentially transferred to the intermediary transfer body 50. Accordingly, a superimposed toner image is formed.

On the other hand, in a sheet feeding section 20, recording media are fed one-by-one from one of multiple sheet feeding cassettes 21 by a corresponding set of transportation rollers and separation rollers 22, and the recording media thus fed are sent out to a sheet feeding channel in the image forming section 60. The image forming apparatus 1 is designed in order that sheets can also be fed by what is termed as a manual sheet feeding mechanism instead of by this sheet feeding section 20. A manual sheet feeding tray (not illustrated) for manual sheet feeding as well as transportation rollers and separation rollers (none of the rollers are illustrated) for separating recording media on the manual sheet feeding tray one-by-one and transporting them to a manual sheet feeding channel is also provided to a side surface of the apparatus. A recording medium fed from one of the sheet feeding cassettes 21 is once stopped from being transported, and thus the position of the recording medium is corrected, by the resist rollers 23. Thereafter, the resist rollers 23 rotates to the position of the superimposed toner image on the intermediary transfer body 50 by causing the rotational timing of the resist rollers 23 corresponding to the rotational timing of the intermediary transfer body 50. Thus, the recording medium is sent to a secondary transfer section which is a section where the intermediary transfer body 50 and the secondary transfer device 51 abut on each other. The toner images are transferred to the top of the recording medium by a development bias applied for the secondary transfer and by a pressure produced by the abutment.

The recording medium obtained as a result of the image transfer is transported to the fixing device 80 by a transportation belt in the secondary transfer device 51, and is thus pressed and heated by pressing rollers 81. Thereby, the toner images are fixed to the recording medium. Subsequently, the recording medium is discharged to a copy receiving tray 40 by discharging rollers 41.

The present example has been described focusing mainly on the charging roller embodied by the conductive member 10. The conductive member 10 according to the present invention may be used as development rollers or transfer rollers as long as such use is not against the object of the example of the present invention.

EXAMPLE 1

A resin composition was produced by mixing 50% by weight of an ABS resin (DENKA ABS GR-0500 manufactured by Denki Kagaku Kogyo Kabushiki Kaisha) and 50% by weight of polyether ester amide (IRGASTAT P18, manufactured by Ciba Specialty Chemicals) together. 5 part by weight of polycarbonate-glycidyl methacrylate-styrene-acrylonitrile copolymer (MODIPER CL440-G, NOF Corporation) was mixed into 100 part by weight of the resin composition. Thereafter, a melted and kneaded resin composition was produced by melting and kneading the mixture. This melted and kneaded composition was ejected to a conductive supporter 1 (core shaft) with an external diameter of 10 mm which was made of a nickel-plated sulfur free cutting steel (SUM). Thus, the conductive supporter 1 was coated with the melted and kneaded composition. Thereby, an electrical resistance adjusting layer 2 was formed. Gap maintaining members 4 and 4 each shaped like a ring (having a discontinuous portion in its part), which were made of a high-density polyethylene resin (Novatech PP HY540, manufactured by Japan Polychem Corporation), were arranged in the two end portions of this electrical resistance adjusting layer 2, and thus were fixed to the electrical resistance adjusting layer 2 with an adhesive. Subsequently, as shown in FIG. 4, by use of a cutting tool, a cutting process was applied to one gap maintaining member 4 and the electrical resistance adjusting layer 2 which were fixed to each other with the adhesive. Thereby, the gap maintaining member 4 was caused to have an external diameter (maximum diameter) of 12.7 mm, and the electrical resistance adjusting layer 2 was caused to have an external diameter of 12.6 mm. During the cutting process, an external diameter stepped portion 6 with a taper 7 was formed in a joint section 5 between the gap maintaining member 4 and the electrical resistance adjusting layer 2 by progressing the cutting tool by 1 mm in the horizontal direction for a 0.1 mm cutting in the vertical direction. The taper 7 was formed with the joint section between the gap maintaining member 4 and the electrical resistance adjusting layer 2 placed in the middle of the taper 7. A gentle slope was formed in the taper 7, and accordingly an angle in the corner portion of the gap maintaining member 4 was blunted. Subsequently, all of the rest of the electrical resistance adjusting layer 2 was cut toward the other gap maintaining member at the opposite side. Thereafter, the other stepped portion 6 with the taper 7 was formed by progressing the cutting tool by 1 mm in the horizontal direction for a 0.1 mm cutting in the vertical direction. At this point, for the purpose of avoid a backlash error, the cutting tool was once removed from the gap maintaining member 4 after the stepped portion 6 was formed. Another cutting process was applied to the stepped portion 6 once again. The stepped portion 6 thus formed had the same shape as the stepped portion 6 in which this series of cutting process had been started. In addition, the taper 7 was formed with the section between the maintaining member 4 and the electrical resistance adjusting layer 2 placed in the middle of the taper 7. Thereafter, a coating made of an acrylic silicon resin (3000VH-P, manufactured by Kawakami Toryo Kabushiki Kaisha), an isocyanate-based curing agent (manufactured by Kawakami Toryo Kabushiki Kasha) and a carbon black (30% by weight in all the solid portion) was sprayed to the surface of the electrical resistance adjusting layer 2. Thereby, a surface layer 3 with a film thickness of approximately 10 μm was formed. Afterward, the surface layer 3 was heated at a temperature of 80° C. for one hour in an oven, and thus the resin constituting the coating was thermally hardened. Thereby, the conductive member 10 was obtained.

EXAMPLE 2

A resin composition was produced by mixing 50% by weight of an ABS resin (DENKA ABS GR-0500 manufactured by Denki Kagaku Kogyo Kabushiki Kaisha) and 50% by weight of polyether ester amide (IRGASTAT P18, manufactured by Ciba Specialty Chemicals) together. 5 part by weight of polycarbonate-glycidyl methacrylate-styrene-acrylonitrile copolymer (MODIPER CL440-G, NOF Corporation) was mixed into 100 part by weight of the resin composition. Thereafter, a melted and kneaded resin composition was produced by melting and kneading the mixture. This melted and kneaded composition was ejected to a conductive supporter 1 (core shaft) with an external diameter of 10 mm which was made of a nickel-plated sulfur free cutting steel (SUM). Thus, the conductive supporter 1 was coated with the melted and kneaded composition. Thereby, an electrical-resistance adjusting layer 2 was formed. Gap maintaining members 4 and 4 each shaped like a ring (having a discontinuous portion in its part), which were made of a high-density polyethylene resin (Novatech PP HY540, manufactured by Japan Polychem Corporation), were arranged in the two end portions of this electrical resistance adjusting layer 2, and thus were fixed to the electrical resistance adjusting layer 2 with an adhesive. Subsequently, as shown in FIG. 5, by use of a cutting tool, a cutting process was applied to one gap maintaining member 4 and the electrical resistance adjusting layer 2 which were fixed to each other with the adhesive. Thereby, the gap maintaining member 4 was caused to have an external diameter (maximum diameter) of 12.7 mm, and the electrical resistance adjusting layer 2 was caused to have an external diameter of 12.6 mm. In addition, an external diameter stepped portion 6 with a chamfer 8 was formed in a joint section 5 between the gap maintaining member 4 and the electrical resistance adjusting layer 2, the chamfer 8 being formed convex with a radius of 0.1 mm for a 0.1 mm cutting in the vertical direction. During the process, the nose R of the cutting tool was reduced down to 0.4 R, and thereby the R portion of the chamfer 8 was processed fine. The chamfer 8 was formed with the joint section 5 between the gap maintaining member 4 and the electrical resistance adjusting layer 2 placed in the middle of the chamfer 8. This chamfer 8 made it possible to cause an angle in the corner portion of the gap maintaining member 4 to be the smallest. Subsequently, all of the rest of the electrical resistance adjusting layer 2 was cut toward the other gap maintaining member at the opposite side. Thereafter, the other stepped portion 6 with the chamfer 8 was formed, the chamfer 8 being formed convex with a radius of 0.1 mm for a 0.1 mm cutting in the vertical direction. At this point, for the purpose of avoid a backlash error, the cutting tool was once removed from the gap maintaining member 4 after the stepped portion 6 was formed. Another cutting process was applied to the stepped portion 6 once again. The stepped portion 6 thus formed had the same shape as the stepped portion 6 in which this series of cutting process had been started. In addition, this chamfer 8 was formed with the section between the maintaining member 4 and the electrical resistance adjusting layer 2 placed in the middle of the taper 7. Thereafter, a coating made of an acrylic silicon resin (3000VH-P, manufactured by Kawakami Toryo Kabushiki Kaisha), an isocyanate-based curing agent (manufactured by Kawakami Toryo Kabushiki Kasha) and a carbon black (30% by weight in all the solid portion) was sprayed to the surface of the electrical resistance adjusting layer 2. Thereby, a surface layer 3 with a film thickness of approximately 10 μm was formed. Afterward, the surface layer 3 was heated at a temperature of 80° C. for one hour in an oven, and thus the resin constituting the coating was thermally hardened. Thereby, the conductive member 10 was obtained.

COMPARATIVE EXAMPLE 1

Figure 6:
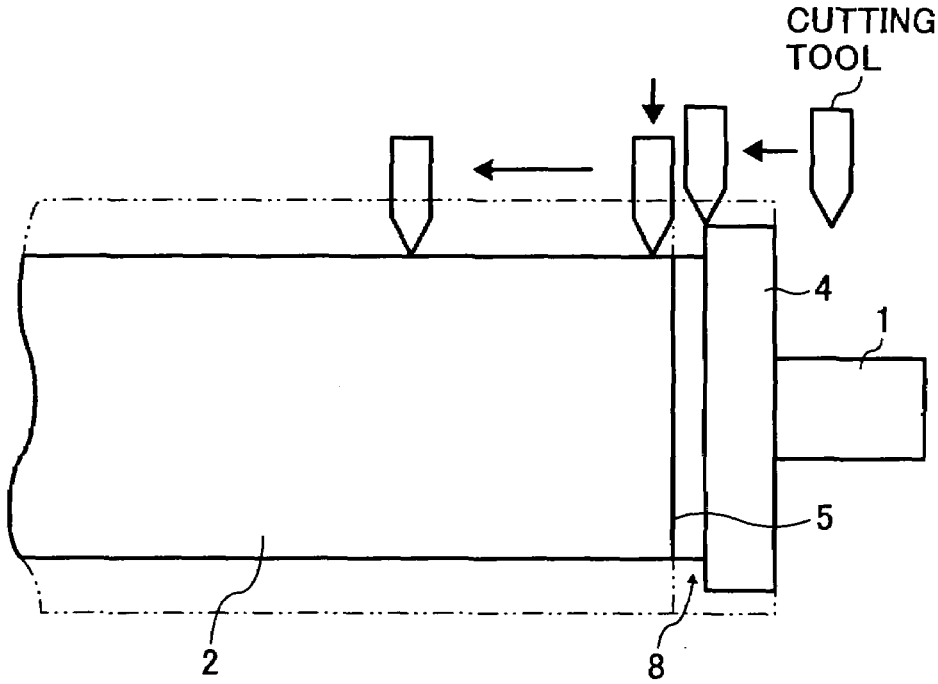
FIG. 6 is an explanatory view showing how a removing process is applied to a conductive member (charging roller) of a conventional type.

A resin composition was produced by mixing 50% by weight of an ABS resin (DENKA ABS GR-0500 manufactured by Denki Kagaku Kogyo Kabushiki Kaisha) and 50% by weight of polyether ester amide (IRGASTAT P18, manufactured by Ciba Specialty Chemicals) together. 5 part by weight of polycarbonate-glycidyl methacrylate-styrene-acrylonitrile copolymer (MODIPER CL440-G, NOF Corporation) was mixed into 100 part by weight of the resin composition. Thereafter, a melted and kneaded resin composition was produced by melting and kneading the mixture. This melted and kneaded composition was ejected to a conductive supporter 1 (core shaft) with an external diameter of 10 mm which was made of a nickel-plated sulfur free cutting steel (SUM). Thus, the conductive supporter 1 was coated with the melted and kneaded composition. Thereby, an electrical-resistance adjusting layer 2 was formed. Gap maintaining members 4 and 4 each shaped like a ring (having a discontinuous portion in its part), which were made of a high-density polyethylene resin (Novatech PP HY540, manufactured by Japan Polychem Corporation), were arranged in the two end portions of this electrical resistance adjusting layer 2, and thus were fixed to the electrical resistance adjusting layer 2 with an adhesive. Subsequently, as shown in FIG. 6, by use of a cutting tool, a cutting process was applied to one gap maintaining member 4 and the electrical resistance adjusting layer 2 which were fixed to each other with the adhesive. Thereby, the gap maintaining member 4 was caused to have an external diameter (maximum diameter) of 12.7 mm, and the electrical resistance adjusting layer 2 was caused to have an external diameter of 12.6 mm. During the process, the vicinity of the joint section 5 between the gap maintaining member 4 and the electrical resistance adjusting layer 2 was cut by progressing the cutting tool in the vertical direction, and thereby an external diameter stepped portion 6 was formed. In this stepped portion 6, the slope was formed in response to 3 R which was three times as large as the nose R of the cutting tool. However, the slope angle was not larger than 30°, and the end portion of the gap maintaining member 4 was angular. Subsequently, all of the rest of the electrical resistance adjusting layer 2 was cut toward the other gap maintaining member at the opposite side. Thereafter, the other stepped portion 6 was formed by progressing the cutting tool in the vertical direction. At this point, for the purpose of avoid a backlash error, the cutting tool was once removed from the gap maintaining member 4 after the stepped portion 6 was formed. Another cutting process was applied to the stepped portion 6 once again. The stepped portion 6 thus formed had the same shape as the stepped portion 6 in which this series of cutting process had been started. Thereafter, a coating made of an acrylic silicon resin (3000VH-P, manufactured by Kawakami Toryo Kabushiki Kaisha), an isocyanate-based curing agent (manufactured by Kawakami Toryo Kabushiki Kasha) and a carbon black (30% by weight in all the solid portion) was sprayed to the surface of the electrical resistance adjusting layer 2. Thereby, a surface layer 3 with a film thickness of approximately 10 μm was formed. Afterward, the surface layer 3 was heated at a temperature of 80° C. for one hour in an oven, and thus the resin constituting the coating was thermally hardened. Thereby, the conductive member 10 was obtained.

As a charging roller, each of the conductive members 10 obtained respectively in Example 1, Example 2 and Comparative Example 1 was installed in the image forming apparatus (see FIG. 7). The distance of the gap G between the image carrier 61 and each of the conductive members (charging rollers) 10 was measured. In addition, a DC voltage to be applied thereto was set at −800V whereas an AC voltage to be applied thereto was set at 2400Vpp (with a frequency of 2 KHz), and 300 k sheets (in A4 size placed in the horizontal direction) were caused to run through the image forming apparatus. Thereby, the conductive members 10 obtained respectively in Example 1, Example 2 and Comparative Example 1 were evaluated in terms of: (1) how unevenly each of the conductive members (charging rollers) 10 was charged; (2) how the distance of the gap G between the image carrier 61 and each of the conductive members (charging rollers) 10 changed; (3) in what condition the gap maintaining members 4 and 4 of each of the conductive members (charging rollers) 10 were; and (4) in what condition the image carrier 61 was for each of the conductive members (charging rollers) 10. With regard to the evaluation environment, the temperature was set at 23° C., and the humidity was set at 60% RH. Moreover, the efficiency of discharging chips (chips adhering around the processed part) during the cutting process for finishing the external diameter of each the gap maintaining members 4 and the electrical resistance adjusting layer 2 was evaluated for each of the conductive members (charging rollers) 10. Table 1 shows the result of the evaluations. Evaluation criteria are as follows:

good: not unevenly charged medium: slightly unevenly charged, but not problematic in practical use poor: unevenly charged to a large extent

TABLE 1

| | Distance of Gap (mm) | | Uneven Charge | |
|---|---|---|---|---|
| | Before 300K | After 300K | Before 300K | After 300K |
| Example 1 | 0.098 | 0.09 | good | good |
| Example 2 | 0.097 | 0.092 | good | good |
| Comparative Example 1 | 0.122 | 0.051 | medium | poor |

As shown in Table 1, the distance of the gap G was stable, and no uneven discharge was observed, "Before 300K" and "After 300" in each of Examples 1 and 2. In Comparative Example 1, however, even "Before 300K," damages were observed on the image carrier 61; what looked like burrs were produced in the corner portion in the end portion of each of the gap maintaining members 4; the distance of the gap G between the image carrier 61 and each of the gap maintaining members 4 became uneven and varied to a large extent while the conductive member (charging roller) and the image carrier 61 were rotating; and noise accordingly occurred in an image. In Comparative Example 1, "After 300K," uneven charge occurred due to an abnormal discharge; and it was observed that the insulating layer came off in the portion in which the image carrier 61 abuts on one of the gap maintaining members 4. One may consider that the phenomena took place because burrs in the corner portion in the end portion of the gap maintaining member 4 damaged the image carrier 61. Furthermore, in Comparative Example 1, there occurred a trouble that, while the stepped portion 6 was being processed, chips entered the interstice between the electrical resistance adjusting layer 2 and each of the gap maintaining members 4 so that the chips adhered around the processed part.

As described above, the conductive member according to the example of the present invention makes it possible to maintain the gap with the certain clearance between the image carrier and the conductive member, to thus charge the surface of the image carrier evenly, and to accordingly enhance the durability, even though used for a long period of time. Furthermore, the conductive member according to the example of the present invention makes it possible to reduce the likelihood that, while the stepped portion is being processed in the joint section between the electrical resistance adjusting layer and each of the gap maintaining members by the removing process, burrs may be produced, parts of the external diameter may extend, and chips may adhere around the processed part. Furthermore, the example of the present invention makes it possible to provide a conductive member capable of suppressing reduction of the life of tools to be used while a removing process is being applied to the conductive member.

In the case of the conductive member according to the example of the present invention, the inclination CL in each of the stepped portions is capable of being formed efficiently with high accuracy because the inclination CL is formed by the removing processes inclusive of the cutting process and the grinding process.

In the case of the conductive member according to the example of the present invention, stress concentration is eased in the section where the image carrier abuts on each of the stepped portions in which the slope is formed because the inclination CL is a taper or a chamfer. This makes it possible to further enhance the durability.

The conductive member according to the example of the present invention is cylindrical so that the conductive member is capable of being driven to rotate. For this reason, the conductive member makes it possible to prevent continuous discharge from a single portion which would otherwise occur, to thus reduce chemical deterioration of the surface of the image carrier which would otherwise occur due to electrification stress, and to accordingly extend the life of the image carrier.

In the case where the conductive member according to the example of the present invention is used as a charging roller, the gap is capable of being maintained with a certain clearance. Thereby, the conductive member makes it possible to prevent an abnormal discharge, to prevent discharging products from being produced, and to prevent a toner from adhering thereto. This makes it possible to prevent the charging roller from being stained and deteriorated.

The process cartridge according to the example of the present invention makes it possible to obtain a stable image quality for a longer period of time, and makes user's maintenance easier. That is because the cartridge includes the conductive member according to the example of the present invention as the charging roller.

The image forming apparatus according to the example of the present invention is more reliable, and makes it possible to obtain a higher image quality. This is because the image forming apparatus uses the process cartridge including the conductive member according to the example of the present invention as the charging roller.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A conductive member to be disposed so as to abut on an image carrier, comprising:

an elongate conductive supporter;

an electrical resistance adjusting layer formed on a circumferential surface of the conductive supporter; and a pair of gap maintaining members provided respectively to two ends of the electrical resistance adjusting layer, wherein outer circumferential surfaces of the respective gap maintaining members are formed such that the outer circumferential surfaces of the respective gap maintaining members are positioned radially outward of an outer circumferential surface of the electrical resistance adjusting layer to form a gap with a certain clearance between the outer circumferential surface of the electrical resistance adjusting layer and an outer circumferential surface of the image carrier provided in parallel to the electrical resistance adjusting layer when the outer circumferential surfaces of the respective gap maintaining members abut on the outer circumferential surface the image carrier, wherein an external diameter stepped portion which does not abut on the outer circumferential surface of the image carrier is formed in a joint section between the electrical resistance adjusting layer and each of the gap maintaining members with the joint section placed axially in a middle of the stepped portion, and wherein an inclination is formed so as to be continuously inclined from the outer circumferential surface of each of the gap maintaining members to the outer circumferential surface of the electrical resistance adjusting layer in the stepped portion.

2. The conductive member as recited in claim 1, wherein the inclination is formed by removing processes such as a cutting process and a grinding process.

3. The conductive member as recited in claim 1, wherein the conductive member is cylindrical.

4. The conductive member as recited in claim 1, wherein the conductive member is used as a charging roller.

5. A process cartridge comprising the charging roller as recited in claim 4 which is provided in a way that the charging roller is arranged close to a charged body.

6. An image forming apparatus comprising the process cartridge as recited in claim 5.

7. A conductive member to be disposed so as to abut on an image carrier, comprising:

an elongate conductive supporter;

an electrical resistance adjusting layer formed on a circumferential surface of the conductive supporter; and a pair of gap maintaining members provided respectively to the two ends of the electrical resistance adjusting layer, wherein outer circumferential surfaces of the respective gap maintaining members are formed such that the outer circumferential surfaces of the respective gap maintaining members are positioned radially outward of an outer circumferential surface of the electrical resistance adjusting layer to form a gap with a certain clearance between the outer circumferential surface of the electrical resistance adjusting layer and an outer circumferential surface of the image carrier provided in parallel to the electrical resistance adjusting layer when the outer circumferential surfaces of the respective gap maintaining members abut on the outer circumferential surface the image carrier, wherein an external diameter stepped portion which does not abut on the outer circumferential surface of the image carrier is formed in a joint section between the electrical resistance adjusting layer and each of the gap maintaining members with the joint section placed axially in a middle of the stepped portion, and wherein a taper is formed so as to be continuously inclined from the outer circumferential surface of each of the gap maintaining members to the outer circumferential surface of the electrical resistance adjusting layer in the stepped portion.

8. The conductive member as recited in claim 7, wherein the taper is formed by removing processes such as a cutting process and a grinding process.

9. The conductive member as recited in claim 7, wherein the conductive member is cylindrical.

10. The conductive member as recited in claim 7, wherein the conductive member is used as a charging roller.

11. A process cartridge comprising the charging roller as recited in claim 10 which is provided in a way that the charging roller is arranged close to a charged body.

12. An image forming apparatus comprising the process cartridge as recited in claim 11.

13. A conductive member to be disposed so as to abut on an image carrier, comprising:

an elongate conductive supporter;

an electrical resistance adjusting layer formed on a circumferential surface of the conductive supporter; and a pair of gap maintaining members provided respectively to the two ends of the electrical resistance adjusting layer, wherein outer circumferential surfaces of the respective gap maintaining members are formed such that the outer circumferential surfaces of the respective gap maintaining members are positioned radially outward of an outer circumferential surface of the electrical resistance adjusting layer to form a gap with a certain clearance between the outer circumferential surface of the electrical resistance adjusting layer and an outer circumferential surface of the image carrier provided in parallel to the electrical resistance adjusting layer when the outer circumferential surfaces of the respective gap maintaining members abut on the outer circumferential surface the image carrier, wherein an external diameter stepped portion which does not abut on the outer circumferential surface of the image carrier is formed in a joint section between the electrical resistance adjusting layer and each of the gap maintaining members with the joint section placed axially in a middle of the stepped portion, and wherein a chamfer is formed so as to be continuously inclined from the outer circumferential surface of each of the gap maintaining members to the outer circumferential surface of the electrical resistance adjusting layer in the stepped portion.

14. The conductive member as recited in claim 13, wherein the chamfer is formed by removing processes such as a cutting process and a grinding process.

15. The conductive member as recited in claim 13, wherein the conductive member is cylindrical.

16. The conductive member as recited in claim 13, wherein the conductive member is used as a charging roller.

17. A process cartridge comprising the charging roller as recited in claim 16 which is provided in a way that the charging roller is arranged close to a charged body.

18. An image forming apparatus comprising the process cartridge as recited in claim 17.

* * * * *